United States Patent [19]

Douglas et al.

[11] Patent Number: 4,572,378

[45] Date of Patent: Feb. 25, 1986

[54] SEPARATION METHOD AND APPARATUS

[75] Inventors: Edward Douglas, Welwyn; Maurice I. Webb, Stevenage, both of England

[73] Assignee: National Research Development Corporation, London, England

[21] Appl. No.: 654,043

[22] Filed: Sep. 24, 1984

Related U.S. Application Data

[63] Continuation of Ser. No. 398,883, Jul. 16, 1982, abandoned.

[30] Foreign Application Priority Data

Jul. 17, 1981 [GB] United Kingdom ..... 8122078

[51] Int. Cl.[4] ..... B07C 5/34

[52] U.S. Cl. ..... 209/640; 209/637; 209/919; 366/196

[58] Field of Search ..... 209/638, 640, 695, 908, 209/911, 915, 918, 921, 925, 930, 933, 637, 642; 222/410; 366/195, 196, 317

[56] References Cited

U.S. PATENT DOCUMENTS

| | | | |
|---|---|---|---|
| 592,774 | 11/1897 | Frazier | 222/410 |
| 643,912 | 2/1900 | Schunk | 209/640 |
| 1,358,375 | 11/1920 | Koch | 209/638 |
| 2,305,203 | 12/1942 | Smith | 222/410 |
| 3,184,081 | 5/1965 | Perdue et al. . | |
| 3,209,925 | 10/1965 | Coenen . | |
| 3,394,804 | 7/1968 | Reichel | 209/920 |
| 3,587,857 | 6/1971 | Reznik | 209/640 |

FOREIGN PATENT DOCUMENTS

| | | | |
|---|---|---|---|
| 729347 | 7/1932 | France . | |
| 978008 | 4/1951 | France . | |
| 1512375 | 1/1968 | France . | |
| 4684 | of 1909 | United Kingdom | 209/640 |
| 270066 | 5/1927 | United Kingdom . | |
| 757994 | 9/1956 | United Kingdom . | |
| 1177136 | 1/1970 | United Kingdom | 209/640 |
| 1454989 | 11/1976 | United Kingdom | 209/640 |

*Primary Examiner*—Randolph A. Reese
*Assistant Examiner*—Donald T. Hajec
*Attorney, Agent, or Firm*—Cushman, Darby & Cushman

[57] ABSTRACT

Apparatus and method for separating discrete items of different materials from a mixture. The mixed items fall vertically from a feeder device onto a plate spinning about a vertical axis. According to their difference in material, the items rebound with different trajectories so that they land on separate receiving surfaces lying at different radii from the axis. The receiving surfaces may be stationary or maybe vibratable, so that items received by them are conveyed along them by vibration to collection points.

6 Claims, 2 Drawing Figures

SEPARATION METHOD AND APPARATUS

This is a continuation of application Ser. No. 398,883, filed July 16, 1982, now abandoned.

This invention relates to a method and apparatus of separating discrete items of different materials from a mixture. It relates in particular to the separation of the waste that remains once the ferrous components have been removed by magnetic extraction from the scrap that results when cars and other consumer goods are shredded. This waste contains items of valuable non-ferrous metal, and items of rubber, plastics and other residues that are less valuable but still possibly worth recovery. Hand sorting of such scrap, which is common practice, is becoming increasingly expensive and is inefficient, particularly in the finer size ranges. Many mechanical methods of separation have been proposed and some are in practice, but all have their disadvantages. For example the method and apparatus proposed in U.K. Pat. No. 1,454,989 involves propelling the scrap so that each piece of it lands upon and then executes a sliding trajectory over an inclined plate: the different frictional properties and densities of metal pieces on the one hand, and rubber or plastics on the other, cause them to execute different trajectories, and they tend to collect into piles at the ends of their respective trajectories at the foot of the inclined plate. This proposal has been used with some success, but at the throughputs required in the industry considerable particle interference occurs, resulting in entrainment and inefficiency. It has been appreciated that these disadvantages could be diminished if the plate was in motion, and in particular if it rotated. Examples of rotating plate separators are described in U.S. Pat. No. 3,587,857 (FIG. 6) and UK Specification 1,177,136 but the apparatus and methods shown in such examples were both intended primarily for the separation of mixtures including vegetable matter and would not be suitable for the sorting of shredded car scrap at economic commercial rates. In addition the operations described in UK Specification 1,177,136 all require the mixture to be propelled into impact with the rotating plate, and thus suffer from one of the disadvantages already mentioned in connection with U.K. Pat. No. 1,454,989.

The present invention includes apparatus for separating discrete items of different materials from a mixture and comprises a separator surface rotatable about a substantially vertical axis, means for feeding mixture onto and around the rotating surface so that the items of the mixture have a substantial component of downward velocity as they meet the surface and whereby the resulting impact imparts substantially different subsequent trajectories to different items, at least some of these trajectories throwing the respective items well clear of the plate, and at least one means is provided to separate and collect the items according to the difference between these trajectories.

The mixture may fall onto the plate under gravity, for instance after release from a hopper. This release may be controlled, for instance by a rotating blade operating with a plough-like action within the hopper outlet. This outlet may be cylindrical in shape, defined between the open bottom of a cylindrical vessel and a horizontal plate fixed slightly below that bottom, so that the locus of impact between the items and the separator surface is a circle or other continous curve rather than a point or points. Alternatively the mixture may fall in a stream at an even rate under gravity from a vibrating feeder device onto a distributor which then releases the items so that they fall from it in a cascade of tubular form. The distributor may for instance take the form of a conical surface, apex upwards, fitted with radial vanes and mounted to rotate about the same vertical axis as that of the stream which falls upon it from the vibrating feeder.

The separator surface is preferably a flat, horizontal circular plate mounted for rotation about a vertical axis beneath the hopper outlet: the plate and the plough may be coaxial. Other shapes of separator plate—for instance dished, or in the form of a shallow cone with apex upwards, are also possible.

The means for separating the items according to their different trajectories after impact with the plate may comprise a wall surrounding and spaced from the plate so that the trajectory of some items takes them over the wall whereas others strike it and fall within it. The different trajectories of the various items may land them onto different stationary surfaces from which they may later be collected separately. As one alternative arrangement the items may fall onto different moving or vibrating surfaces that contribute to conveying those items further towards chutes or other collecting vessels or surfaces.

The vertical height of the point of release of the hopper or distributor above the plate may be variable, thereby to vary the vertical velocity of the items of the mixture as they make impact with the plate.

The invention also includes a method of separating discrete items of different materials from a mixture. In particular the invention includes a method using the apparatus as just described. In general the method includes feeding a mixture so that its constituent items acquire a substantial vertical velocity by gravity, and make contact with a surface spinning about a vertical axis. The items are then separated by reference to the different trajectories they take up following that contact.

The invention is defined by the claims at the end of this sepcification, the disclosure of which is also to be considered as part of the disclosure of this specification.

The invention will now be described, by way of example, with reference to the accompanying drawings in which.

Figure 1:
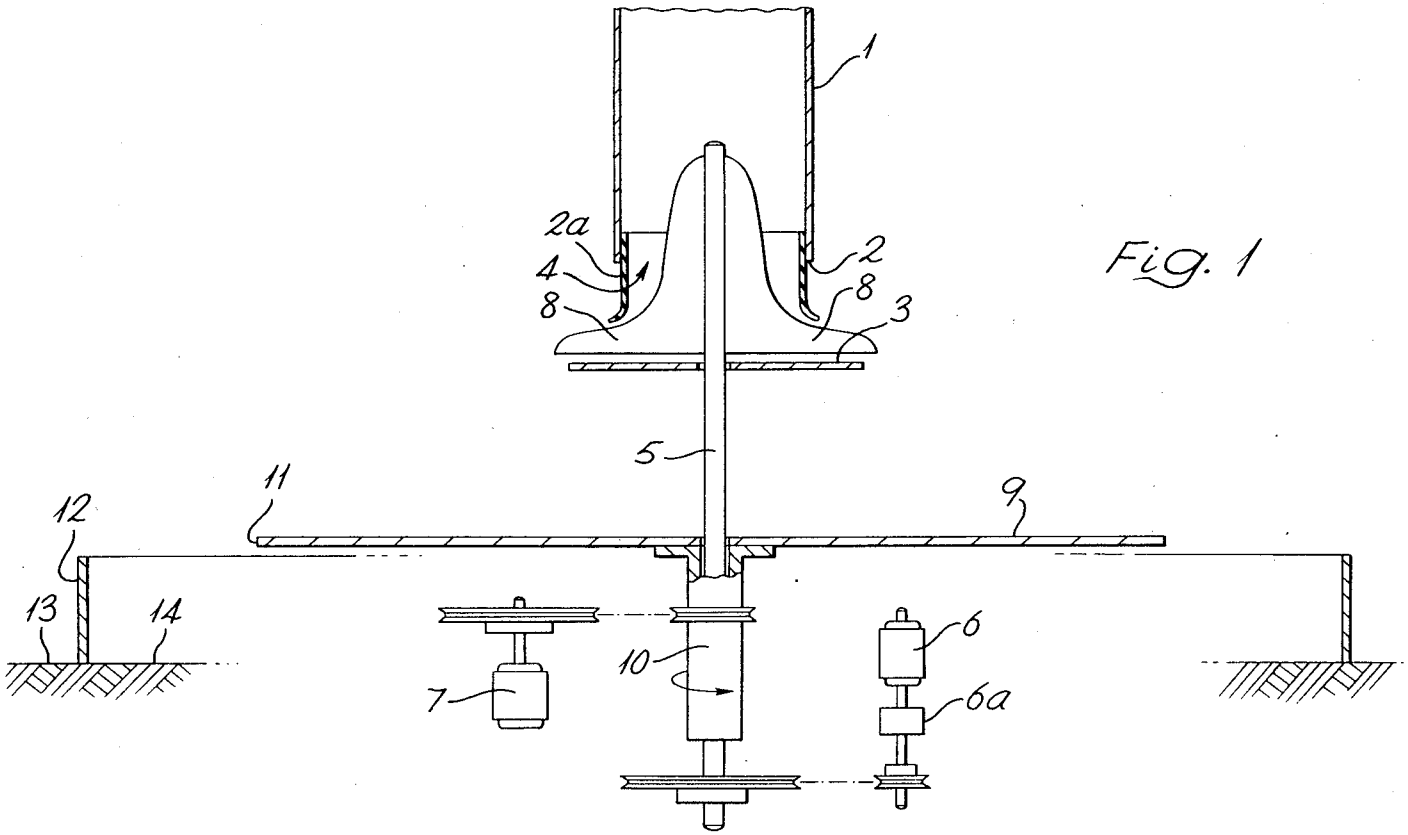
FIG. 1 is a diagrammatic vertical section through one apparatus.

The apparatus of FIG. 1 includes a feeder device comprising a cylindrical hopper 1, located with its axis vertical and with its lower edge 2 a short distance above a fixed, horizontal, circular plate 3 slightly greater in radius than hopper 1. A flexible skirt 2*a* checks uncontrolled escape of material from the hopper. The hopper is filled with the mixture to be separated, for instance a mixture of shredded car scrap which has passed screens in the size range 15–100 mm.

A rotary plough 4 comprising two or more blades 8 is mounted on a vertical shaft 5 which passes through a central hole (not shown) in plate 3 and is driven by a motor 6 by way of variable reduction gearing 6*a*, and the blades 8 of this plough project into the gap between hopper 1 and plate 3. As plough 4 slowly rotates, items of mixture that have fallen by gravity within the hopper are ploughed continuously and at a controlled rate over the edge of plate 3, so leaving the feeder device to fall by gravity onto the surface of a horizontal, circular plate 9, mounted on a shaft 10 which is coaxial with shaft 5 and rotated by a second motor 7 at a variable speed but much faster than plough 4. The radius of plate 9 is say three times greater than that of the plate 3 so that items falling vertically from the edge of plate 3 strike plate 9 inboard of its edge 11, and the vertical height of plate 3 above plate 9 may be varied, by means not shown, so as to vary the speed at which items hit plate 9.

It will be apparent that when items first make impact with plate 9 they will tend both to bounce vertically and also to acquire a horizontal velocity due to contact with the spinning, horizontal plate. The upward vertical velocity of the items after this impact will vary considerably, due for instance to the different coefficients of rebound between different items and the plate 9. The horizontal velocities will vary also, due largely to the different coefficients of friction between the different items and the plate. In addition the typical shape of the items will influence both types of velocity: in typical shredded car scrap metallic items tend to be heavier and smoother in surface texture than those of rubber or plastics, and these less smooth and less regularly shaped items tend to acquire the greater horizontal velocities. The practical result is that while rubber, plastics and other non-metallic items tend on leaving the plate after first impact to acquire a considerable horizontal velocity, so taking up a long horizontal trajectory without touching plate 9 again, metallic items behave differently. They usually acquire little horizontal velocity and little vertical bounce. Therefore they often only bounce repeatedly on the surface of the plate as the centrifugal force experienced on each impact moves them gradually radially outward until they fall over the edge 11 with relatively little horizontal velocity. By placing a cylindrical boundary member 1 splitting device 12 as shown, therefore, non-metallic items will tend to be thrown over the top of it to land in a reception zone 13 outside it, whereas metallic items will tend to fall into an annular reception zone 14 within the cylinder. Lowering of the height of the splitter, or the substitution of one of the same height but smaller radius will tend towards the result that the proportion of the mixture reporting into zone 14 within splitter 12 diminishes, but becomes richer in the relatively valuable metallic items. If on the contrary the splitter is raised or increased in radius a greater proportion of the mixture reports within the splitter and this fraction of the separated mixture contains a greater proportion of the total valuable metal that was origianlly within the raw mixture, but this fraction also contains a greater volume of non-metallic items that should ideally have reported outside the splitter; this volume will require a further separation exercise, either manual or mechanical, to remove it.

In one series of tests with one such apparatus as just described plate 9 was of mild steel and of radius 660 mm, the radius of plate 3 was 450 mm, and splitter 12 was located 330 mm radially outward from the edge 11 of plate 9 with its crest 200 mm below the plane of the disc. The speed of rotation of shaft 5 and blades 8 was varied between almost zero and 10 rpm, and the speed of rotation of disc 9 was varied between 200 and 800 rpm. Results indicated the prospect of the attainment of commercially useful throughput and percentage separation.

In another series of test with essentially similar apparatus, but in which the scrap had previously been screened to remove both fine and large particles, significantly better results were obtained.

Figure 2:
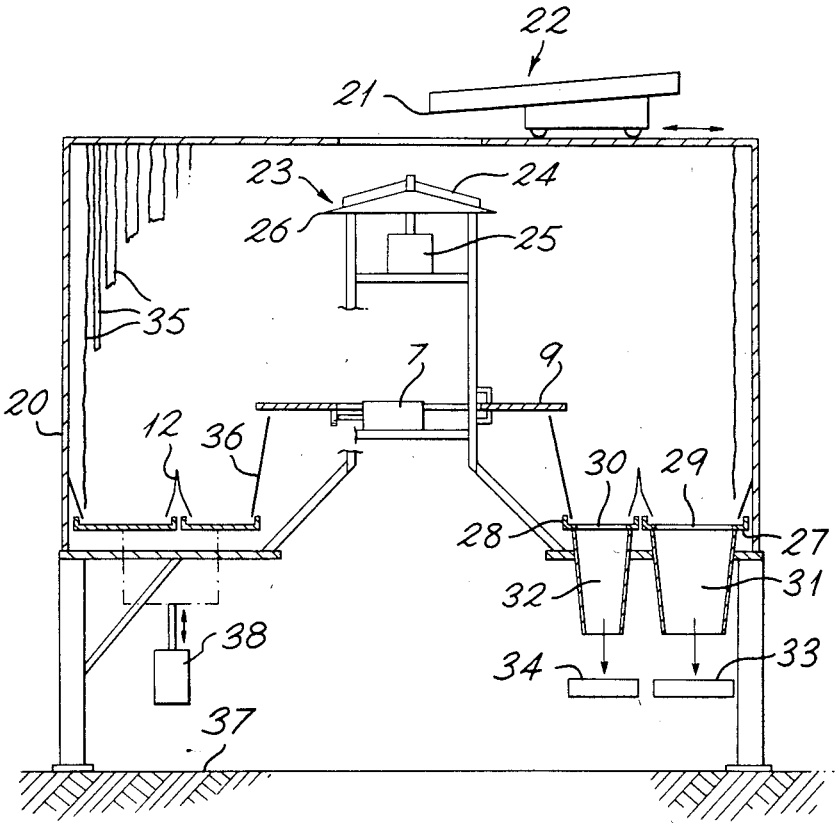
FIG. 2 is a similar view of another apparatus.

In the alternative apparatus shown in FIG. 2, most parts are enclosed within a drum-shaped casing 20. The feeder device includes a vibrating tray 22, from the lip 21 of which items are discharged to fall as a single, vertical stream onto the upward-facing apex of a conical distributor 23 on which radial vanes 24 are mounted, and which is rotated slowly about a veritcal axis by a motor 25. The slow rotation and the action of vanes 24 tend to redistribute the items so that they fall as an evenly-distributed tubular cascade from the edge 26 onto the circular plate 9, rotated at high speed by motor 7 as in FIG. 1. Splitter 12 works as in FIG. 1 also, but in place of the stationary reception zones 13 and 14 there are now annular plates 27 and 28, formed with apertures 29 and 30 respectively. These plates are mounted for vibration in their own planes in known manner by means indicated diagrammatically at 38, so that items landing on them after impact with plate 9 tend to travel towards the apertures 29 and 30, through which they fall through chutes 31, 32 onto collection points 33, 34 for non-metallic and metallic items respectively. A curtain 35 comprising a series of hanging flexible strips, arranged just inside the inner wall of drum 20, saves that wall from direct impact by items destined for plate 27 and also helps to absorb the energy of fast moving non-metallic items and so prevent them rebounding onto plate 28. A fixed shroud 36 ensures that metallic items leaving plate 9 with little or no horizontal velocity do not simply fall to the ground 37 by missing the inner edge of plate 28.

We claim:

1. Apparatus for separating discrete items of different materials from a mixture by reason of their differential reaction with an unobstructed surface comprising:

a spinning plate having said unobstructed surface and presenting a first circular outer edge and being mounted to rotate about a vertical axis;

a rotary feeder device located vertically higher than said spinning plate, adapted to rotate coaxially with but substantially more slowly than said spinning plate and presenting a second circular outer edge coaxial with but substantially smaller in radius than said first circular edge and to feed said items over said second circular outer edge on to said spinning plate so that they fall freely on to said surface and have substantial vertical velocity but substantially zero horizontal velocity when they make first and bouncing impact with said plate and so that the locus of said first impact with said plate is a continuous curve coaxial with said spinning plate so that each item makes said first impact with said surface at substantially the same radius;

at least two separate reception zones to receive said items as they subsequently pass outwardly over said first circular outer edge with different paths of movement by reason of their different material; and a boundary member adjacent said reception zones, said boundary member being substantially circular and coaxial with said spinning plate, one said adjacent zone lying radially outwards of said boundary member and the other said adjacent zone lying radially inwards of said boundary member.

2. Apparatus for separating discrete items, according to claim 1, wherein:

said rotary feeder device includes a circular member mounted to rotate coaxially with said spinning plate, and presenting a conical surface with apex upwards, said feeder device also including means located above said conical surface to discharge said items under gravity onto said apex of said conical surface.

3. Apparatus for separating discrete items, according to claim 2, further including vanes mounted on said conical surface to promote even distribution of said items received onto said apex from above.

4. Apparatus for separating discrete items, according to claim 1, in which said reception zones comprise adjacent stationary annular surfaces, and in which said boundary member comprises an upstanding wall located between said annular surfaces.

5. Apparatus for separating discrete items, according to claim 1, wherein:

said reception zones comprise separate, concentric receiving surfaces;

vibrator means are associated with said surfaces whereby said items after landing on said surfaces are conveyed along said surfaces by vibration, and collection points are provided to receive said items after being so conveyed.

6. A method of separating discrete items of different materials from a mixture, including the steps of:

discharging said items from a rotary feeder device so that they descend from it under gravity as a hollow tubular stream having a first radius about an axis;

causing said descending items to acquire substantial vertical but substantially zero horizontal velocity;

causing said items, with said acquired velocity, to make first and bouncing impact, all at substantially said first radius, with a circular plate spinning about the axis of said hollow tubular stream said plate having an outer radius substantially greater than said first radius;

causing said items by reason of contact with said spinning plate to acquire horizontal velocity so that they pass outwardly over the outer edge of said circular plate, said items so passing with different paths of movement by reason of their difference of material whereby said items having high rebound resilience will bounce clear of said spinning plate after said first impact alone while said items having less rebound resilience will bounce repeatedly at increasing radius upon said spinning plate until they fall over said outer edge of said spinning plate;

receiving said items having passed outwardly over said outer edge of said circular plate in at least two separate reception zones, said zones being annular and coaxial with said spinning plate but located at different radii relative to the axis of said plate.

* * * * *